US008676082B2

(12) United States Patent
Shin

(10) Patent No.: US 8,676,082 B2
(45) Date of Patent: Mar. 18, 2014

(54) IMAGE FORMING APPARATUS

(75) Inventor: Koji Shin, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 225 days.

(21) Appl. No.: 13/192,080

(22) Filed: Jul. 27, 2011

(65) Prior Publication Data

US 2012/0027451 A1 Feb. 2, 2012

(30) Foreign Application Priority Data

Jul. 30, 2010 (JP) ..... 2010-172372

(51) Int. Cl.
*G03G 21/00* (2006.01)

(52) U.S. Cl.
USPC ..... 399/98; 399/92

(58) Field of Classification Search
USPC ..... 399/98, 92
See application file for complete search history.

(56) References Cited

U.S. PATENT DOCUMENTS

| | | | | |
|---|---|---|---|---|
| 6,411,788 | B1 * | 6/2002 | Ogasawara | 399/92 |
| 7,403,732 | B2 * | 7/2008 | Shimazu et al. | 399/92 |

FOREIGN PATENT DOCUMENTS

| | | |
|---|---|---|
| JP | 63-177873 | 11/1988 |
| JP | 02-284174 | 11/1990 |
| JP | 05-333704 | 12/1993 |
| JP | 07-175338 | 7/1995 |
| JP | 09-281863 | 10/1997 |
| JP | 2004-240055 | 8/2004 |

OTHER PUBLICATIONS

Office Action issued for Japanese Application No. 2010-172372 mailed Aug. 7, 2012.

* cited by examiner

*Primary Examiner* — David Gray
*Assistant Examiner* — Carla Therrien
(74) *Attorney, Agent, or Firm* — Pearl Cohen Zedek Latzer Baratz LLP

(57) ABSTRACT

An image forming apparatus according to the present invention includes: a photoreceptor drum that is provided along a paper path of transfer paper; a discharging unit including a light emitting body that emits discharging light, the discharging unit eliminating electrical charge on a surface of the photoreceptor drum; a blast unit that is provided to blow air toward the discharging unit; and a air duct that is provided in the vicinity of the light emitting body, and is configured such that the air from the blast unit toward the discharging unit is configured to blow to a side of the paper path through the air duct.

4 Claims, 10 Drawing Sheets

IMAGE FORMING APPARATUS

CROSS-REFERENCE TO RELATED APPLICATIONS

This application is based on and claims the benefit of priority from Japanese Patent Application No. 2010-172372, filed on 30 Jul. 2010, the content of which is incorporated herein by reference.

BACKGROUND OF THE INVENTION

1. Field of the Invention

The present invention relates to an image forming apparatus using xerography such as a printer, a copy machine, a facsimile machine, a multifunction peripheral provided with functions thereof and the like, and particularly to an image forming apparatus provided with a discharging unit for eliminating electrical charge on a surface of a photoreceptor drum.

2. Related Art

Conventionally, an image forming apparatus using xerography has been known that prints an image by forming an electrostatic latent image on a surface of a photoreceptor drum, developing the electrostatic latent image by a toner, and then transferring a toner image to paper and the like. As such an image forming apparatus using xerography, an image forming apparatus as shown in FIG. 10A including: a photoreceptor drum 81 disposed along a paper path 80 of transfer paper; a charging unit 82 that charges a surface of the photoreceptor drum 81 at a predetermined voltage; an exposure unit (not illustrated) that forms an electrostatic latent image by irradiating the surface of the photoreceptor drum with a laser beam P; a developing unit 83 that develops the electrostatic latent image formed by the exposure unit as a toner image on the surface of the photoreceptor drum; a transfer roller 84 that transfers the toner image to the transfer paper in cooperation with the photoreceptor drum 81; a cleaning unit (a cleaning roller 85 and a cleaning blade 86) that removes the toner remaining on the surface of the photoreceptor drum 81 after transfer; and a discharging unit 87 including a light emitting body 88 that emits discharging light for eliminating electrical charge remaining on the surface of the photoreceptor drum after transfer has been known. Note that, in FIGS. 10A and 10B, an arrow shown inside each component shows a rotational direction of the component, and an arrow shown along the paper path 80 of the transfer paper shows a feeding direction of the transfer paper.

In such an image forming apparatus, subsequent charging is performed preferably after sufficiently removing electrical charge from the surface of the photoreceptor drum 81 by the discharging unit 87. However, in a prior art shown in FIG. 10A, since the discharging unit 87 is disposed immediately before the charging unit 82 in a rotational direction of the photoreceptor drum 81, a rotational angle $\alpha$ between a discharging position and a charging position is small and a time interval between discharging and charging is short. Accordingly, if the photoreceptor drum 81 rotates in high speed as a result of increase in processing speed of the image forming apparatus, subsequent charging is started before sufficiently discharging the surface of the photoreceptor drum 81, easily causing an image defect.

Given this, an image forming apparatus as shown in FIG. 10B in which the discharging unit 87 is disposed more on an upstream side in a rotational direction of the photoreceptor drum 81 than the cleaning roller 85 and the cleaning blade 86 has been known. In such a configuration, the cleaning roller 85 and the cleaning blade 86 are disposed between the discharging unit 87 and the charging unit 82, thereby keeping the charging unit 82 away from the discharging unit 87. As a result, the rotational angle $\alpha$ between the discharging position and the charging position can be made greater than in a case of FIG. 10A and a time interval between discharging and charging can be made longer. This can prevent a problem of subsequent charging being started before sufficiently discharging the photoreceptor drum 81.

However, as shown in FIG. 10B, in a case in which the discharging unit 87 is disposed more on the upstream side in the rotational direction of the photoreceptor drum 81 than the cleaning roller 85 and the cleaning blade 86, the discharging unit 87 is disposed close to the paper path 80 of the transfer paper. Generally, in the vicinity of the paper path 80, matters such as paper dust and unfixed toner generated in paper feeding, as well as residual toner remaining on the surface of the photoreceptor drum 81 after transfer, are scattered. Accordingly, if the discharging unit 87 is disposed in the vicinity of the paper path 80, a surface of the light emitting body 88 fixed to the discharging unit 87 is contaminated with the above-mentioned scattered matters, thereby reducing intensity of discharging light emitted from the light emitting body 88. As a result, it is difficult for the discharging unit 87 to exert an original discharging ability and an image defect may be caused.

Given this, a configuration in which the surface of the light emitting body 88 is cleaned by a cleaning member and a configuration in which the surface of the light emitting body 88 is covered with dustproof glass or the like have been known.

However, by employing the configuration in which the cleaning member for cleaning the surface of the light emitting body is provided and the configuration in which the surface of the light emitting body is covered with dustproof glass or the like, a new problem of increased number and cost of components arises.

SUMMARY OF THE INVENTION

Given this, the present invention aims at providing an image forming apparatus that can prevent contamination of the surface of the light emitting body without employing a configuration for cleaning the light emitting body.

An image forming apparatus according to the present invention includes: a photoreceptor drum that is provided along a paper path of transfer paper; a discharging unit including a light emitting body that emits discharging light, the discharging unit eliminating electrical charge on a surface of the photoreceptor drum; a blast unit that is provided to blow air toward the discharging unit; and a air duct that is provided in the vicinity of the light emitting body, and is configured such that the air from the blast unit toward the discharging unit is configured to blow to a side of the paper path through the air duct.

The image forming apparatus according to the present invention can provide an image forming apparatus that can prevent contamination of the surface of the light emitting body without employing a configuration for cleaning the light emitting body.

DETAILED DESCRIPTION OF THE INVENTION

Figure 1:
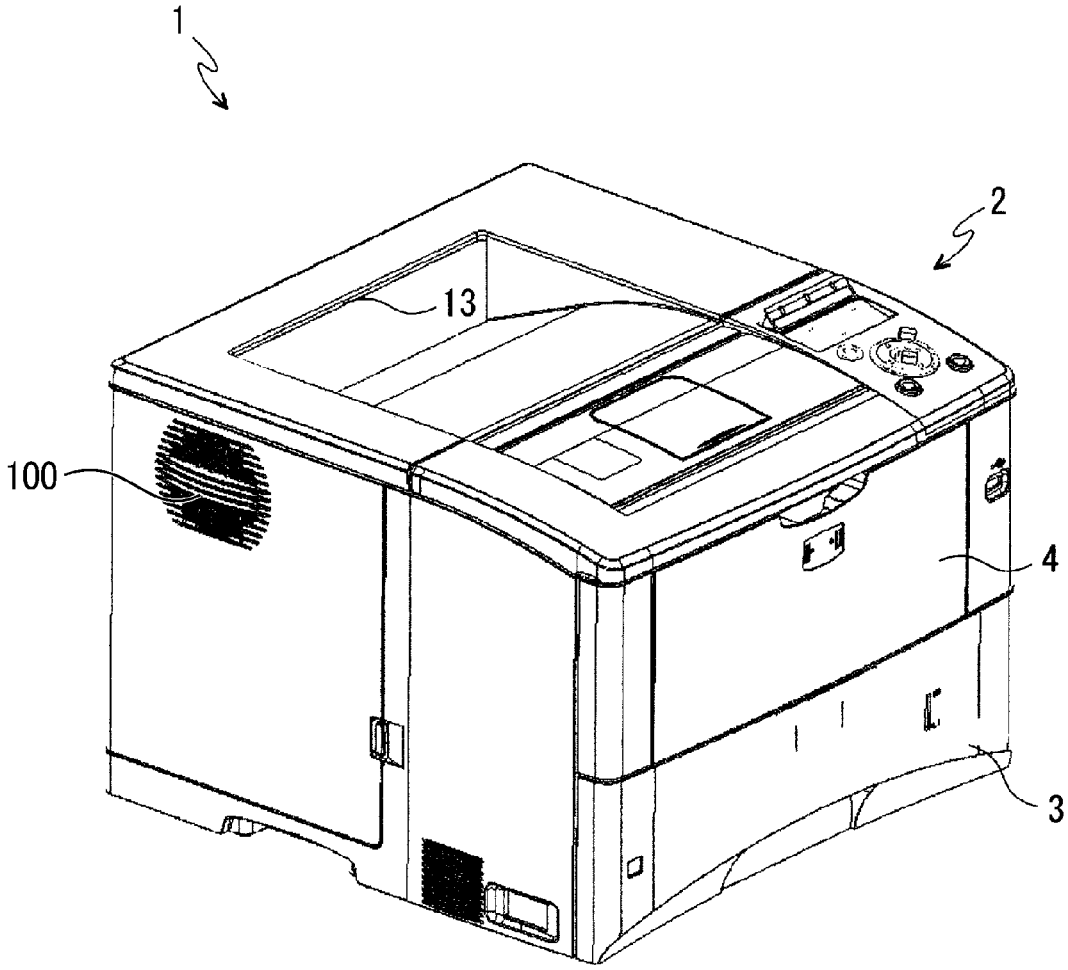
FIG. 1 is a perspective view of an image forming apparatus according to an embodiment of the present invention.
Figure 2:
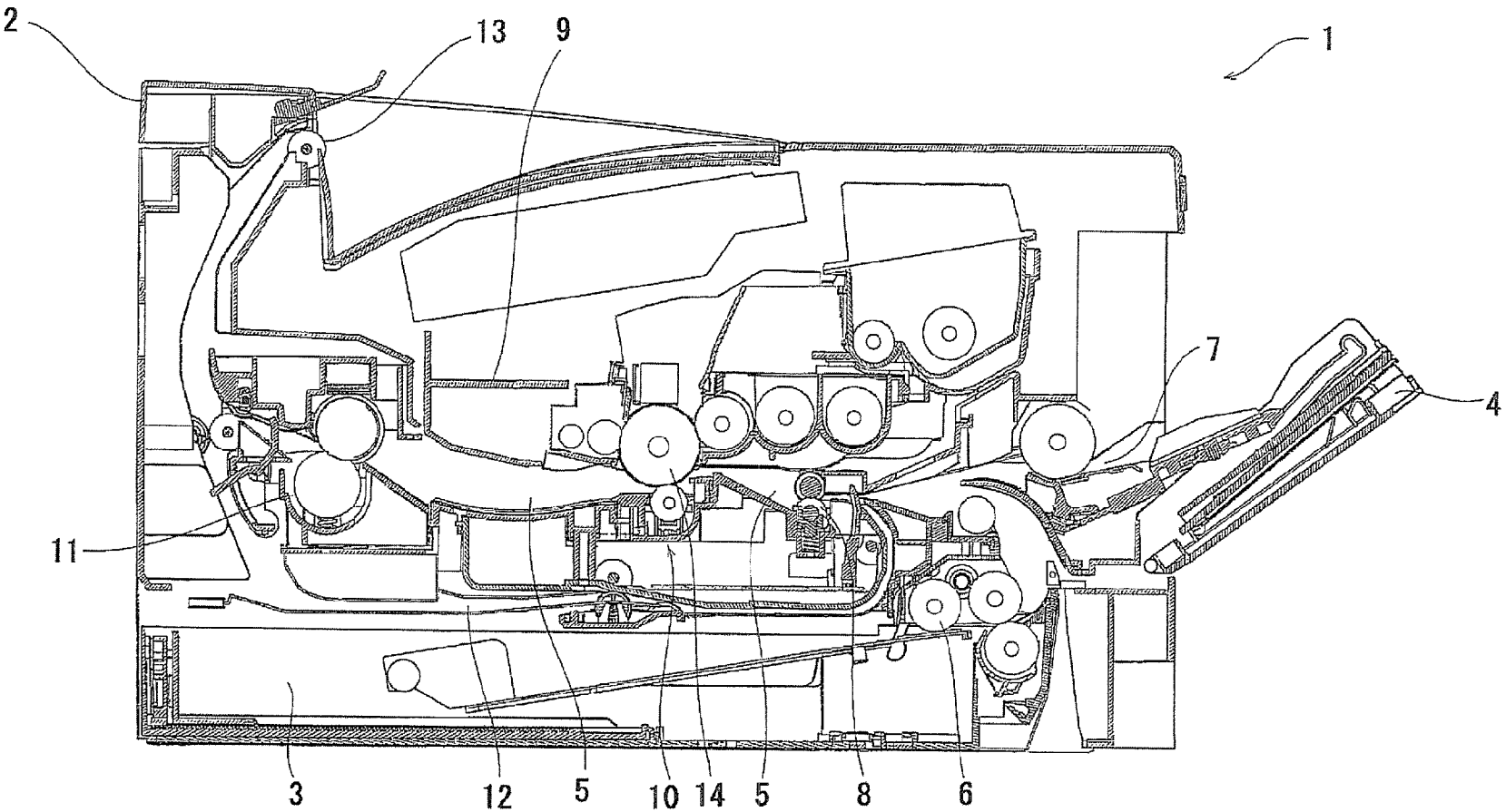
FIG. 2 is a cross-sectional view showing an internal structure of the image forming apparatus according to the embodiment of the present invention.
Figure 3:
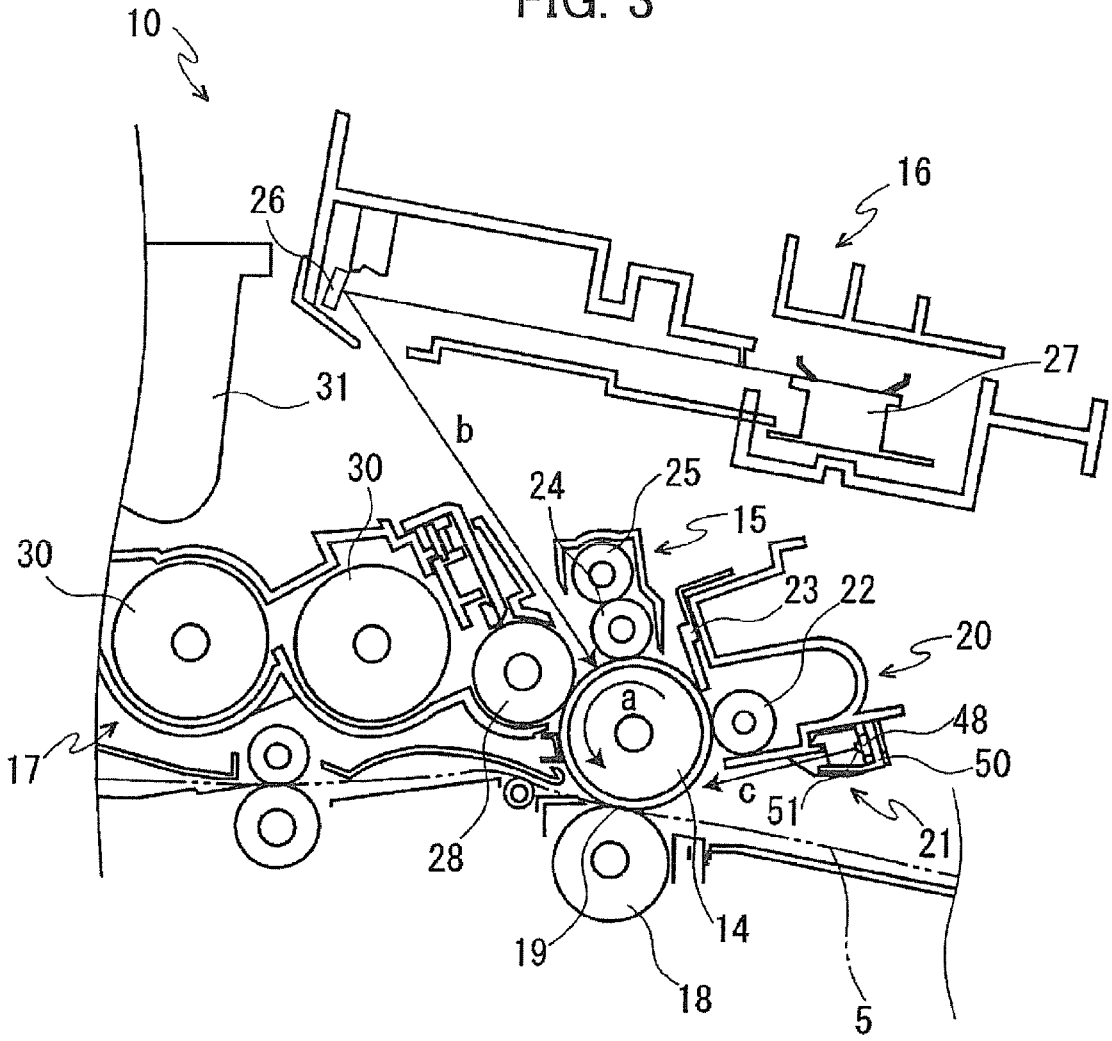
FIG. 3 is an explanatory diagram showing an image forming unit in the image forming apparatus according to the embodiment of the present invention.

A color printer as the image forming apparatus according to an embodiment of the present invention is described hereinafter with reference to FIGS. 1 to 9B. Hereinafter, a face on a right-front side in FIG. 1 is regarded as a front face of the color printer. FIG. 2 is a cross-sectional side view seen from a left side of the color printer; and FIG. 3 is an explanatory diagram seen from a right side of the color printer. Positional relationship of components is horizontally reversed in FIGS. 2 and 3.

The color printer 1 includes, in a box shape printer main body 2: a paper feeding tray 3; a manual feeding tray 4; a paper path 5; a paper feeding unit 6; a manual feeding unit 7; a conveyance roller 8; an image forming unit 10; a fusing unit 11; a reversing path 12; and an ejection opening 13. The paper feeding tray 3 is provided in a lower portion of the printer main body 2 and can be withdrawn from a front face of the printer main body 2. The manual feeding tray 4 is provided in the front face of the printer main body 2 so as to be openable and closable. The paper path 5 conveys the transfer paper stored in the paper feeding tray 3 or the manual feeding tray 4. The paper feeding unit 6 feeds the transfer paper stored in the paper feeding tray 3 to the paper path 5. The manual feeding unit 7 feeds the transfer paper stored in the manual feeding tray 4 to the paper path 5. The conveyance roller 8 is provided on an upstream side in the paper path 5. The image forming unit 10 is provided more on an downstream side in the paper path 5 than the conveyance roller 8. The fusing unit 11 is disposed more on a downstream side in the paper path 5 than the image forming unit 10. The reversing path 12 connects a part of the paper path 5 that is more on the downstream side than the fusing unit 11 and a part of the paper path 5 that is more on the upstream side than the conveyance roller 8. The ejection opening 13 is provided in a downstream end of the paper path 5.

As shown in FIG. 3, the image forming unit 10 includes: a photoreceptor drum 14; a charging unit 15; an exposure unit 16; a developing unit 17; a transfer roller 18; a discharging unit 21; a cleaning roller 22; and a cleaning blade 23. The photoreceptor drum 14 is provided along the paper path 5 for the transfer paper. The charging unit 15 is provided above the photoreceptor drum 14 so as to contact the photoreceptor drum 14. The exposure unit 16 is provided further above the charging unit 15. The developing unit 17 is provided more on a downstream side than the charging unit 15 in a rotational direction of the photoreceptor drum 14 (a direction of an arrow a in FIG. 3, hereinafter simply referred to as rotational direction), so as to contact the photoreceptor drum 14. The transfer roller 18 is provided more on a downstream side in the rotational direction than the developing unit 17, so as to contact the photoreceptor drum 14. The discharging unit 21 is supported by the drum frame 20, more on the downstream side in the rotational direction than the transfer roller 18. The cleaning roller 22 and the cleaning blade 23 functions as a cleaning unit and are provided more on the downstream side in the rotational direction than the discharging unit 21 and more on the upstream side in the rotational direction than the charging unit 15, so as to contact the photoreceptor drum 14.

Figure 4:
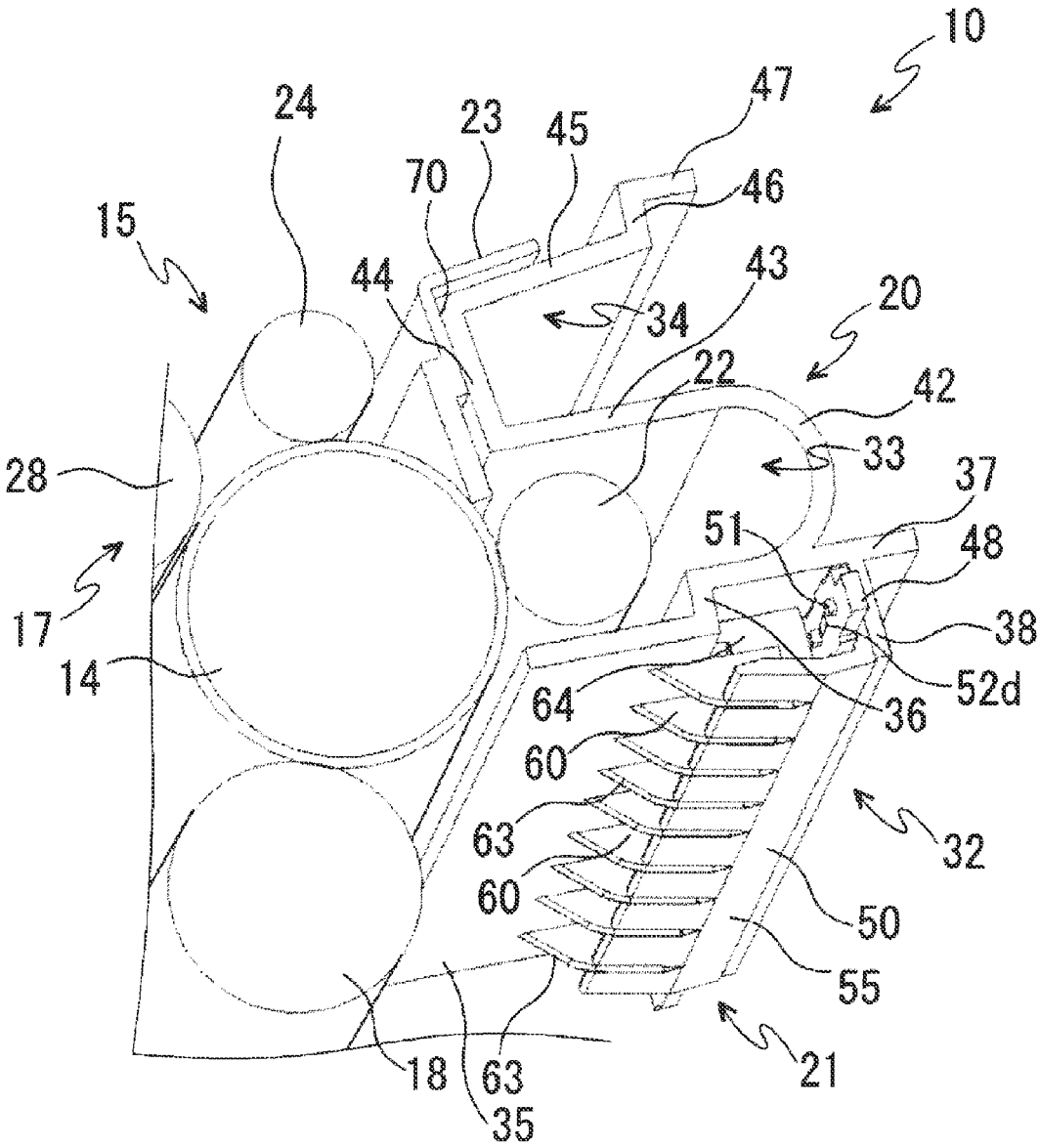
FIG. 4 is a perspective view showing the image forming unit in the image forming apparatus according to the embodiment of the present invention.
Figure 9A:
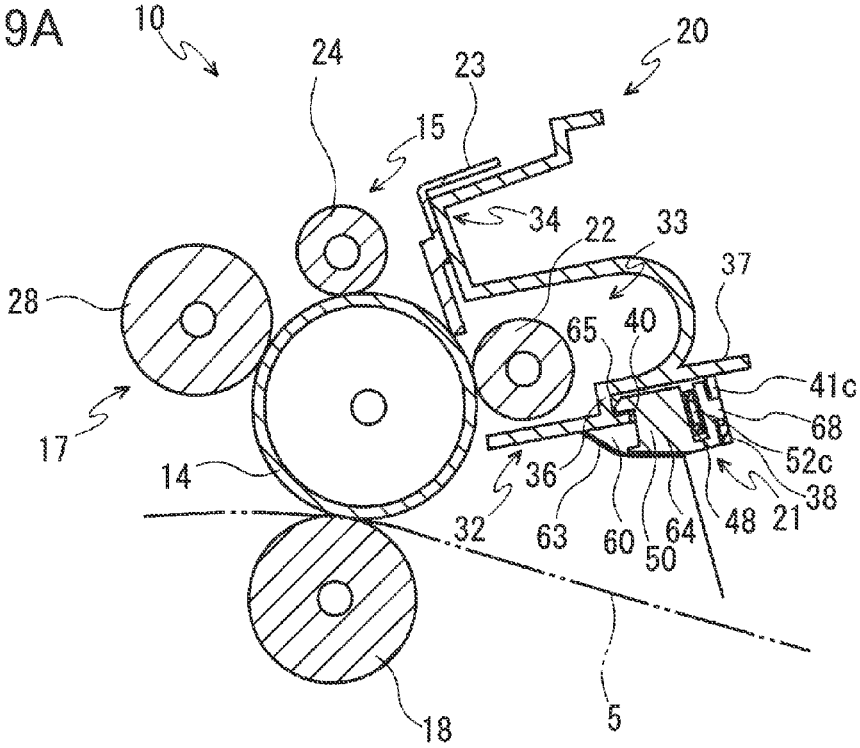
FIG. 9A is a cross-sectional view taken along a line A-A of FIG. 8.
Figure 9B:
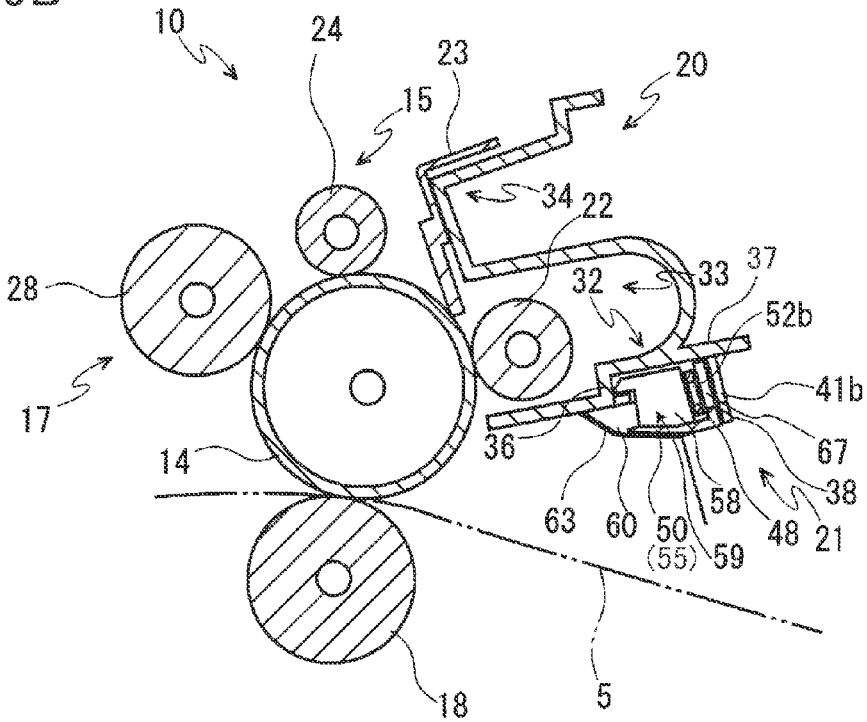
FIG. 9B is a cross-sectional view taken along a line B-B of FIG. 8.
Figure 10A:
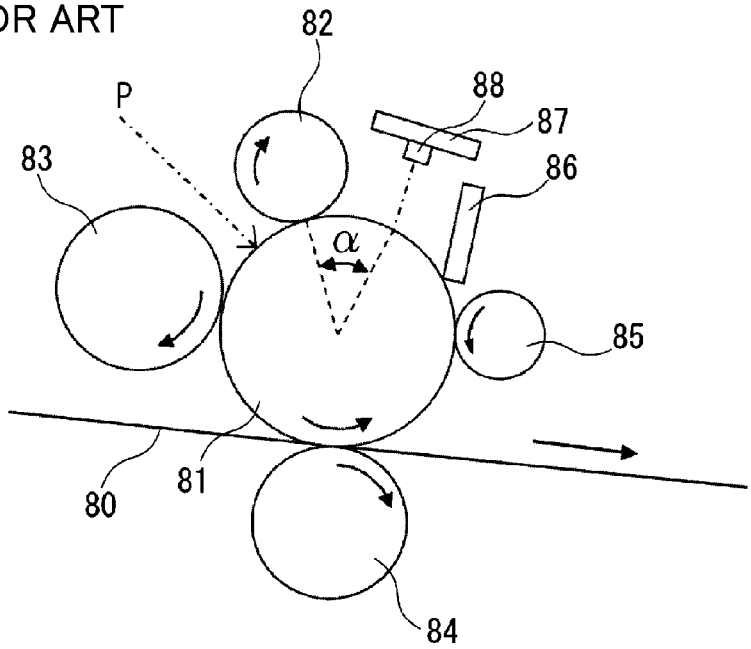
FIG. 10A PRIOR ART
FIG. 10A is an explanatory diagram of an image forming apparatus of a conventional art in which a discharging unit is provided on a downstream side of a cleaning roller and a cleaning blade.
Figure 10B:
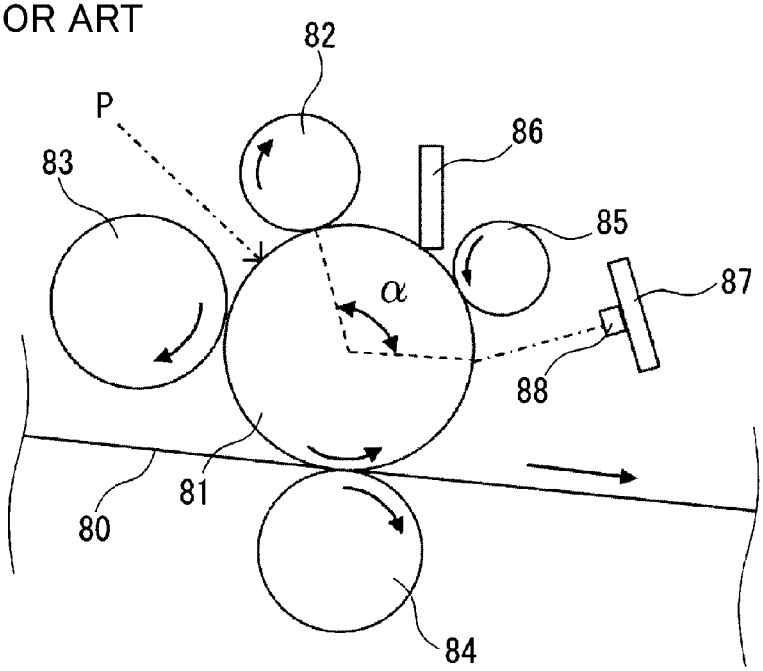
FIG. 10B PRIOR ART
FIG. 10B is an explanatory diagram of an image forming apparatus of a conventional art in which a discharging unit is provided on an upstream side of a cleaning roller and a cleaning blade.

The charging unit 15 includes: a charging roller 24 that contacts a surface of the photoreceptor drum 14 and a removal roller 25 that contacts the charging roller 24 to remove attached matters on the surface thereof. In FIGS. 4, 9A and 9B, the removal roller 25 is omitted, and only the charging roller 24 is illustrated.

The exposure unit 16 includes a reflection mirror 26 that is provided in a front end part thereof; a polygon mirror 27 that is provided in a rear part of the exposure unit 16; and a polygon motor (not illustrated) that rotates the polygon mirror 27. The exposure unit 16 reflects a laser beam, which is incident upon the polygon mirror 27 rotated by the polygon motor, by means of the reflection mirror 26 toward a lower rear side in order to output to the surface of the photoreceptor drum 14, thereby forming an electrostatic latent image on the surface of the photoreceptor drum 14 (see an arrow b in FIG. 3). In FIGS. 4, 9A and 9B, the exposure unit 16 is omitted.

The developing unit 17 includes: a developing roller 28 that is disposed to contact the photoreceptor drum 14; and a pair of spirals 30 that is provided anteroposteriorly in front of the developing roller 28. The developing unit 17 agitates a toner, which is supplied from a toner container 31 provided above and in front of the pair of spirals 30, by means of the pair of spirals 30 and supplies the toner to the surface of the photoreceptor drum 14 via the developing roller 28.

The transfer roller 18 is in pressure contact with the photoreceptor drum 14 and forms a transfer nip 19 along the paper path 5 between the photoreceptor drum 14 and the transfer roller 18. In addition, the transfer roller 18 is connected to a voltage application unit (not illustrated).

Figure 5:
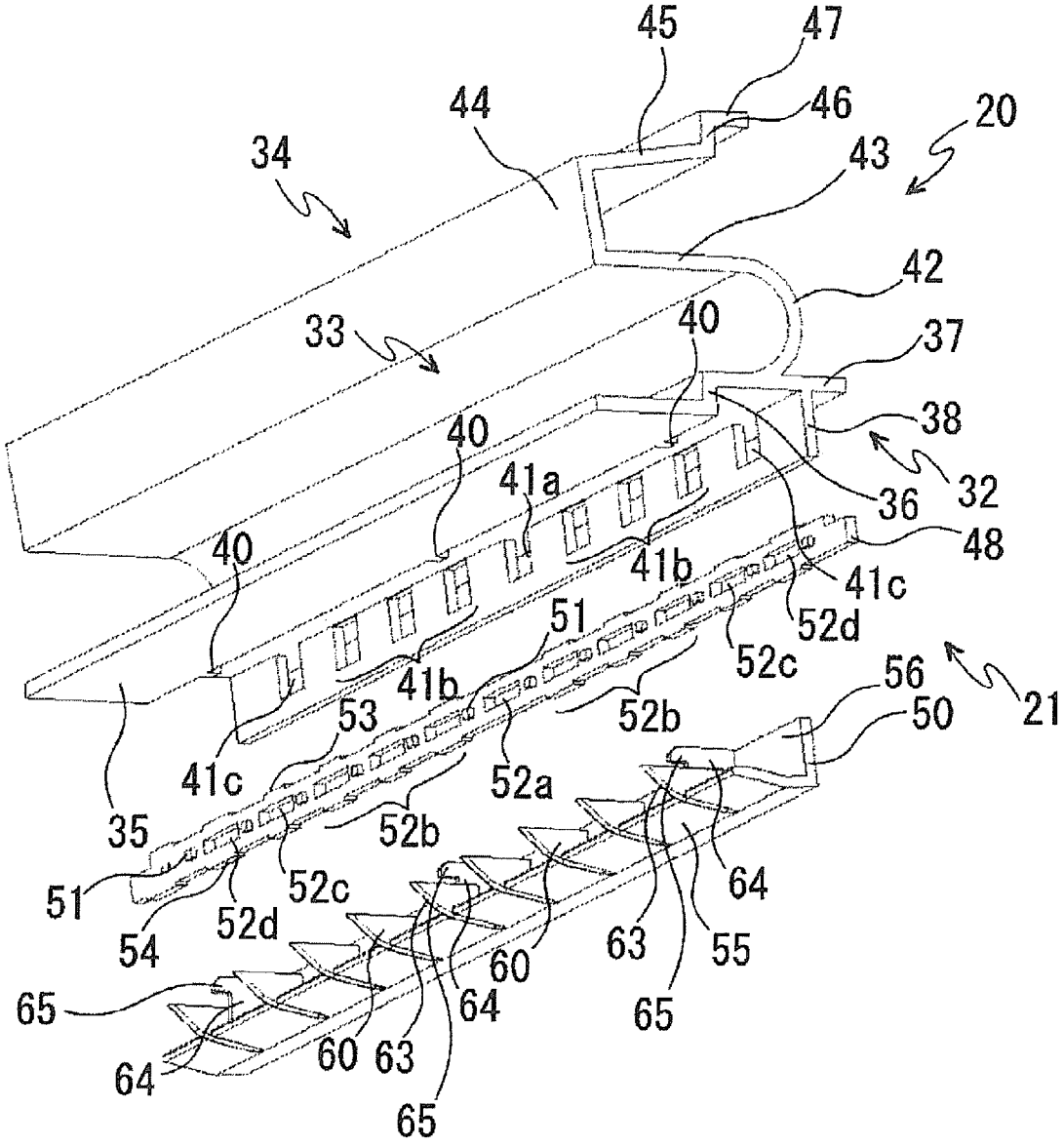
FIG. 5 is an exploded perspective view showing assemblage of a discharging unit to a drum frame in the image forming apparatus according to the embodiment of the present invention.

The drum frame 20 is provided behind the photoreceptor drum 14 so as to face the photoreceptor drum 14. The drum frame 20 is fixed to a main body frame (not illustrated) of the printer main body 2 in a slightly forward-tilted state. As shown in FIGS. 4 and 5, the drum frame 20 includes: a discharging unit attachment part 32 that is provided in a lower end portion thereof; a cleaning roller insertion part 33 that is provided above the discharging unit attachment part 32; and a cleaning blade attachment part 34 that is provided above the cleaning roller insertion part 33.

The discharging unit attachment part 32 includes: a front bottom plate 35; a connection plate 36; a rear bottom plate 37; a projection plate 38; an engaging rib 40; and through holes 41*a*, 41*b* and 41*c*. The front bottom plate 35 is provided such that a front end part thereof faces a peripheral face of the photoreceptor drum 14. The connection plate 36 bends upward substantially vertically from a rear end portion of the front bottom plate 35. The rear bottom plate 37 bends backward substantially vertically from an upper end portion of the connection plate 36. The projection plate 38 is formed to project downward from a rear portion of the rear bottom plate 37. The engagement rib 40 is provided to project backward, in a horizontally central portion and both side portions in a lower end of a rear face of the connection plate 36. Nine through holes are provided on the projection plate 38 at regular intervals in a longitudinal direction, to penetrate in a horizontal direction. One of the nine through holes that is provided in the center is hereinafter referred to as a central through hole 41*a*. Three through holes provided on both sides of the central through hole 41*a* are referred to as side through holes 41*b*. A pair of through holes provided on outer sides of the side through holes 41*b* is referred to as end through holes 41*c*.

The cleaning roller insertion part 33 has a substantially U-shape that is open to a front face side. A lower portion of the cleaning roller insertion part 33 is covered by the front bottom plate 35, the connection plate 36, and the rear bottom plate 37. A curved plate 42 is provided to project backward in a semicircular shape, from an upper face of the rear bottom plate 37. A rear portion of the cleaning roller insertion part 33 is covered by the curved plate 42. A center plate 43 extends forward from an upper end of the curved plate 42. An upper portion of the cleaning roller insertion part 33 is covered by the center plate 43.

The cleaning blade attachment part 34 is composed of: a fixing plate 44 that is curved upward from a front end portion of the center plate 43; a top plate 45 that is curved backward from an upper end of the fixing plate 44; an upper end connection plate 46 that is curved upward from a rear end portion of the top plate 45; and an upper end plate 47 that is curved backward from an upper end of the upper end connection plate 46.

Figure 6:
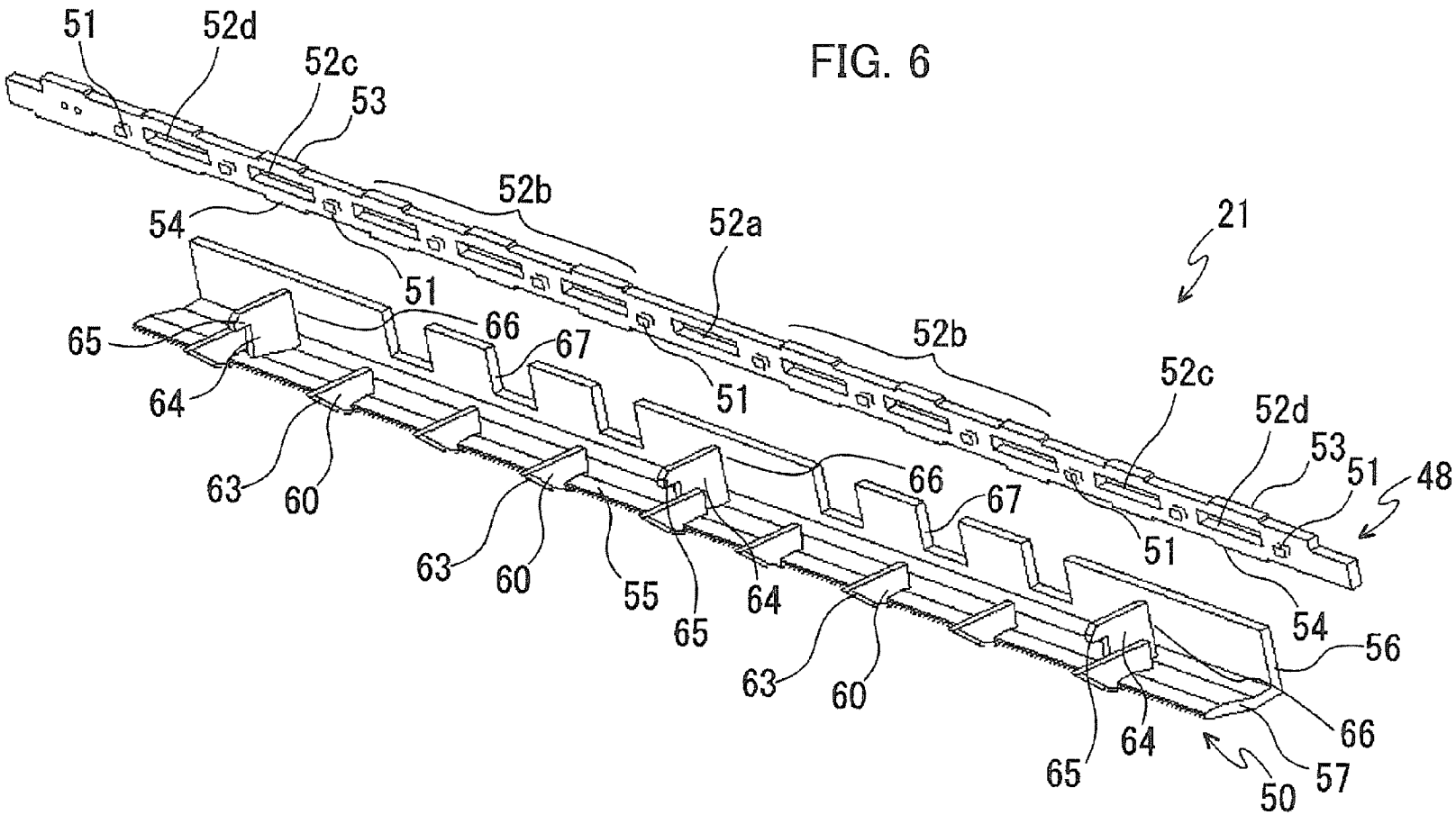
FIG. 6 is an exploded perspective view of the discharging unit in the image forming apparatus according to the embodiment of the present invention.

As shown in FIG. 6, the discharging unit 21 includes: LEDs 51 as a light emitting body; a discharging printed board 48 that is formed of a long and narrow plate material; and a horizontally long holder 50 that supports the discharging printed board 48.

A plurality of LEDs 51 (12 LEDs in the present embodiment) are fixed on a front face of the discharging printed board 48 at regular intervals in a longitudinal direction, by soldering. Between two adjacent LEDs 51, a horizontally long, rectangular shaped hole is provided to penetrate from a front face to a rear face of the discharging printed board 48. In the present embodiment, eleven holes are provided to penetrate the discharging printed board 48. Among the eleven holes, a hole positioned in the center is referred to as a central hole 52*a*. Three holes provided on both sides of the central hole 52*a* are referred to as side holes 52*b*. A pair of holes each of which is provided on an outer side of the side holes 52*b* is referred to as outer holes 52*c*. A pair of holes each of which is provided further on an outer side of the outer holes 52*c* is referred to as end holes 52*d*.

In a state in which the discharging unit 21 is fixed to the drum frame 20, each side hole 52*b* is formed at a position corresponding to the side through hole 41*b* on the drum frame 20. In addition, outer parts of the end holes 52*d* in the discharging printed board 48, and the LEDs 51 on both ends, are set to project outward from both ends of the drum frame 20 and the holder 50. Above and below each of the holes 52*b* to 52*d*, except for the central hole 52*a*, an upper projection 53 and a lower projection 54 are respectively provided that slightly project from upper and lower end edges of the discharging printed board 48.

The holder 50 includes: a bottom plate 55 with a tip portion slightly tilted upward from a base end portion; and a side plate 56 that is curved upward from a rear end portion of the bottom plate, thereby having a substantially L-shaped cross section. In a state in which the discharging unit 21 is fixed to the drum frame 20, a space 58 (see FIG. 9B) is formed between the rear bottom plate 37 of the drum frame 20 and the bottom plate 55 of the holder 50. In a tip portion of the bottom plate 55, a plurality of paper feeding ribs 60 is fixed at regular intervals along a longitudinal direction so as to project from the space 58 toward the paper path 5. Each of the paper feeding ribs 60 is provided to be substantially perpendicular to the longitudinal direction of the bottom plate 55. In a state in which the discharging unit 21 is fixed to the drum frame 20, an upper face of the paper feeding ribs 60 is set to contact a rear side of a lower face of the front bottom plate 35. In addition, on a front face of each of the paper feeding ribs 60, a tilted face 63 that is tilted downward and backward is provided so as to face the paper path 5.

Figure 7:
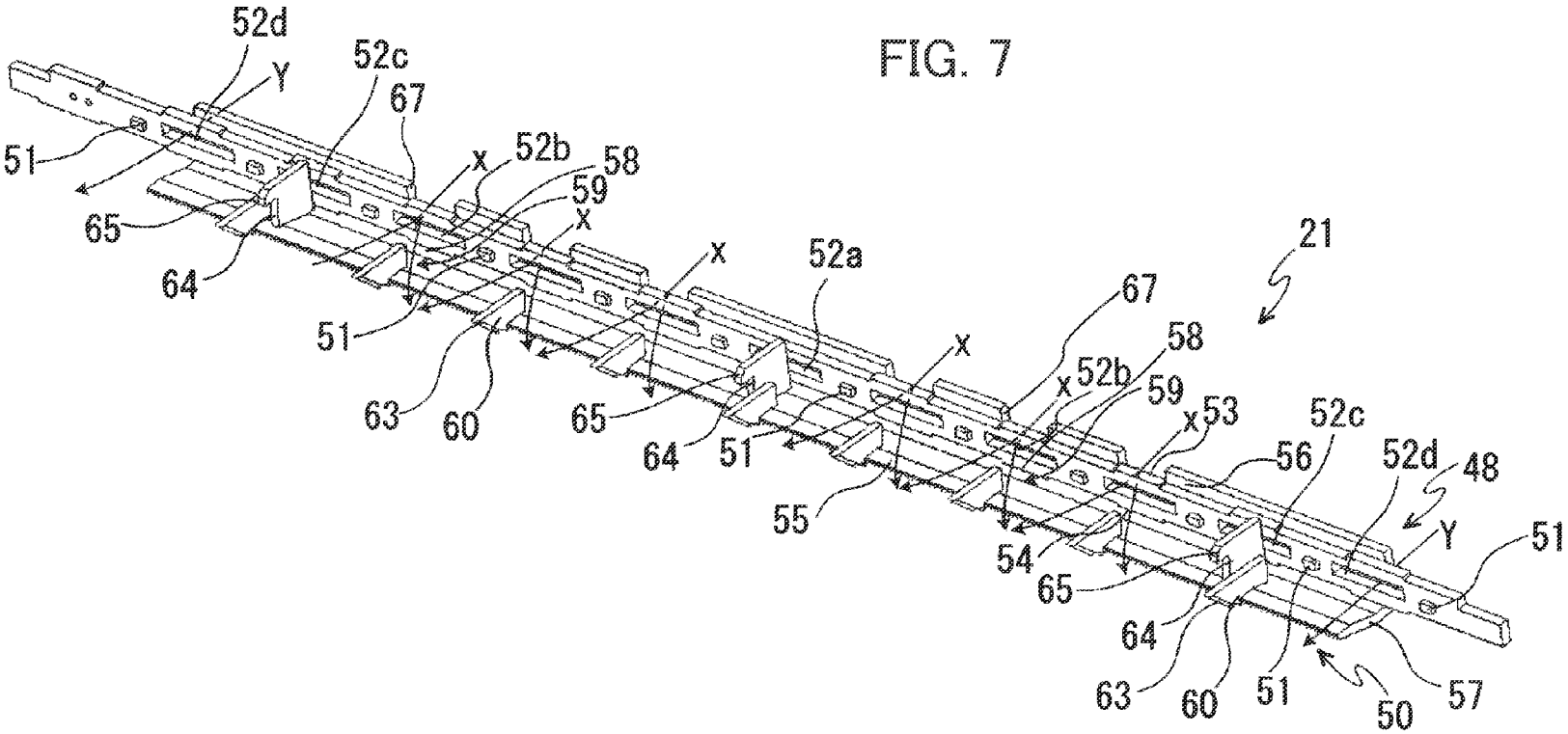
FIG. 7 is a perspective view of the discharging unit in the image forming apparatus according to the embodiment of the present invention.

On a base end side of the upper face of the bottom plate 55, holder plates 64 are fixed in both side portions and a central portion in the longitudinal direction of the bottom plate 55. Each of the holder plates 64 is provided substantially perpendicularly to the longitudinal direction of the bottom plate 55. In an upper end of a front face of each holder plate 64, an engagement projection 65 that projects forward is provided at a position corresponding to the engagement rib 40 on the drum frame 20. A rear face of each holder plate 64 is positioned to face the front face of the side plate 56 with a predetermined insertion gap 66 therebetween. As shown in FIG. 7, by inserting the discharging printed board 48 into the insertion gap 66, the discharging printed board 48 is held between the rear face of the holder plate 64 and the front face of the side plate 56.

Figure 8:
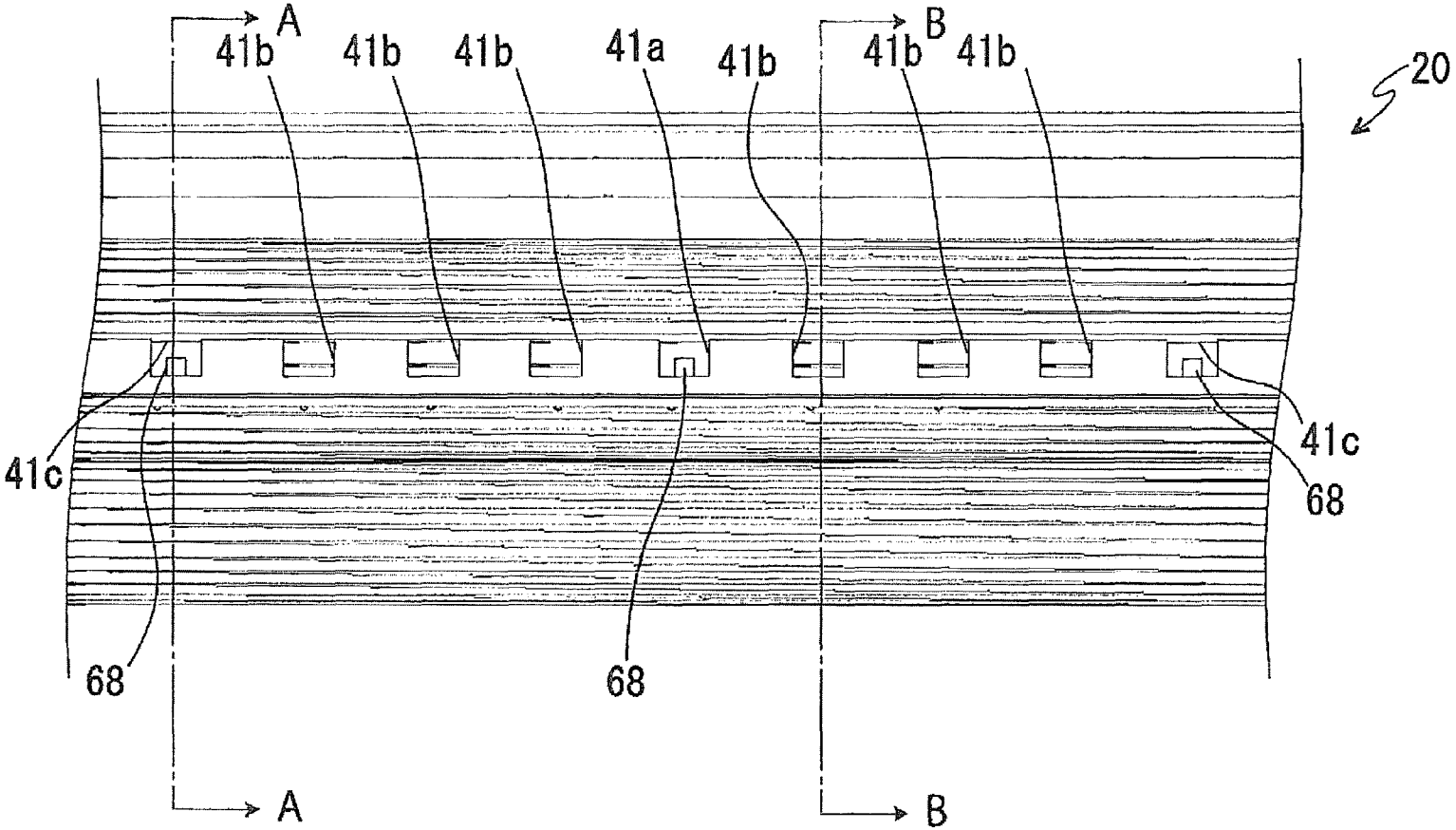
FIG. 8 is a back view of a lower portion of the drum frame in the image forming apparatus according to the embodiment of the present invention.

As shown in FIGS. 8 and 9A, projections 68 are provided in a central portion and both side portions in a lateral direction of the rear face of the side plate 56, at positions corresponding to the central through hole 41*a* and the end through holes 41*c* on the drum frame 20. In a state in which the engagement projection 65 of each holding plate 64 is engaged with each engagement rib 40 of the drum frame 20, by fitting the projection 68 of the side plate 56 of the holder 50 into the central through hole 41*a* and the end through holes 41*c* of the drum frame 20, the discharging unit 21 can be attached to the drum frame 20.

As shown in FIGS. 6 and 7, rectangular notches 67 are provided on the side plate 56, at positions corresponding to the side through holes 41*b* on the drum frame 20 and the side holes 52*b* on the discharging printed board 48. Three notches 67 are provided on both sides along the longitudinal direction of the side plate 56, and extend from an upper end to a lower portion of the side plate 56. As shown in FIGS. 7, 8 and 9B, in a state in which the discharging unit 21 is attached to the drum frame 20, an air duct 59 is formed in the vicinity of each LED 51 by the side through holes 41*b*, the notches 67, the side holes 52*b*, and the space 58. A space behind the drum frame 20 is communicatively connected to a space in front of a lower part of the drum frame 20 (in other words, a space on a side of the paper path 5) through the air duct 59.

As shown in FIG. 4, the cleaning roller 22 is inserted into the cleaning roller insertion part 33 of the drum frame 20. In such a state, the cleaning roller 22 is supported by a supporting arm (not illustrated) in both end portions thereof, and is in pressure contact with the surface of the photoreceptor drum 14 with a predetermined pressure by means of a biasing means (not illustrated).

An upper end portion of the cleaning blade 23 bends backward in an L-shape. A fixing part 70 is provided on a rear face of an upper portion of the cleaning blade 23. The fixing part 70 is fixed to the fixing plate 44 of the cleaning blade attachment part 34 of the drum frame 20. In addition, lower end portion of the cleaning blade 23 is in pressure contact with the surface of the photoreceptor drum 14 with a predetermined pressure.

In the printer main body 2, a cooling fan (not illustrated) 100 as a blast unit is disposed at one side of the right and left side. The cooling fan 100 is provided such as facing one side of a duct 9 which extended right and left direction in the printer main body 2. In other words, the cooling fan 100 is communicatively connected to a space behind the drum frame 20 via the duct 9. As a result, a cooling air supplied from the cooling fan 100 is blown, via the duct 9, in a direction to the discharging unit 21 attached to a lower end of the drum frame 20. It should be noted that the cooling fan 100 is provided in the color printer 1 so as to cool down mainly components inside the printer main body 2 (for example, the polygon motor, a power board and the like).

Image forming operation of the color printer 1 thus configured is described hereinafter.

When the color printer 1 is turned on, various parameters are initialized, and initial setting such as temperature setting of the fusing unit 11 and the like performs. And then, when image data is input from a computer or the like connected to the color printer 1 and a print start instruction is made, image forming operation is performed as follows.

First, the charging unit 15 electrically charges the surface of the photoreceptor drum 14; the exposure unit 16 performs exposure with respect to the photoreceptor drum 14 according to the image data; and an electrostatic latent image is formed on the photoreceptor drum 14. Next, the electrostatic latent image is developed with a toner, to form a toner image of a color of the developing unit 17. By applying voltage of reverse polarity (−) to that of the toner forming the toner image to the transfer roller 18, the toner image, which has been developed by the developing unit 17 on the photoreceptor drum 14, is transferred to the transfer paper that has been conveyed along the paper path 5. The toner image thus transferred to the transfer paper is fused onto the transfer paper in the fusing unit 11. The transfer paper onto which the toner image is fused is ejected to the outside from the ejection opening 13.

Electrical charge remaining on the surface of the photoreceptor drum 14 after completion of transfer is removed by irradiating the surface of the photoreceptor drum 14 with the discharging light from the LED 51 (see an arrow c in FIG. 3). In addition, the residual toner on the surface of the photoreceptor drum 14 after completion of transfer is removed by the cleaning roller 22 and the cleaning blade 23. Thereafter, the charging unit 15 performs charging for the next image formation.

In the present embodiment, the cleaning roller 22 and the cleaning blade 23 are provided more on the upstream side in the rotational direction than the charging unit 15, and the discharging unit 21 is provided more on the upstream side in the rotational direction than the cleaning roller 22 and the cleaning blade 23. Therefor the discharging unit 21 can thus be kept away from the charging unit 15. As a result, a time interval between discharging and charging can be made longer in the image forming operation, and a problem of subsequent charging being started before sufficiently discharging the photoreceptor drum 14 can be prevented.

On the other hand, in a case in which the discharging unit 21 is disposed more on the upstream side in the rotational direction than the cleaning roller 22 and the cleaning blade 23, the discharging unit 21 is disposed close to the paper path 5 of the transfer paper. Generally, in the vicinity of the paper path 5, matters such as paper dust and unfixed toner generated in paper feeding, as well as residual toner remaining on the surface of the photoreceptor drum 14 after transfer, are scattered. Accordingly, if the discharging unit 21 is disposed in the vicinity of the paper path 5, a surface of the LED 51 is contaminated with the abovementioned scattered matters, thereby reducing intensity of discharging light emitted from the LED 51. As a result, it is difficult for the discharging unit 21 to exert an original discharging ability and an image defect may be caused.

Given this, in the present embodiment, contamination of the surface of the LED 51 is prevented by means of a cooling air blown from the cooling fan 100 in a direction to the discharging unit 21 via the duct, as described below.

When the cooling fan 100 is activated upon the image forming operation of the color printer 1, the cooling air is applied to a lower end of a rear face of the drum frame 20, to which the discharging unit 21 is attached. A part of the cooling air is blown toward the paper path 5 via the air duct 59 (see an arrow X in FIG. 7). The cooling air runs at least on one side of the eight LEDs 51 in the center, among the twelve LEDs 51 fixed onto the discharging printed board 48. In addition, a part of the cooling air applied to the rear face of the drum frame 20 is blown toward the paper path 5 via the end holes **52*d* that project outward from both ends of the drum frame 20 and the holder 50 (see an arrow Y in FIG. 7). The cooling air runs on one side of the LEDs 51 other than the abovementioned eight LEDs in the center, among the twelve LEDs 51 fixed onto the discharging printed board 48 (in other words, four LEDs 51 fixed in both end portions of the discharging printed board 48). The cooling air runs on one side and both sides of all of the LEDs 51 and is blown toward the paper path 5**.

In the present embodiment, the cooling air blown from the cooling fan 100 toward the discharging unit 21 is blown toward the paper path 5 via the air duct 59 provided in the vicinity of the LEDs 51. As a result, the abovementioned scattered matter in the vicinity of the paper path 5 does not easily fly in the direction of each LED 51 and can be prevented from attaching to and contaminating the LED 51. In such a configuration, contamination of the surface of the LED 51 can thus be prevented without providing a separate component for protection of the LED 51, and the number of components and manufacturing cost can be reduced. In addition, as the air duct 59 is formed by providing holes and notches on the discharging printed board 48, the hole 50, and the drum frame 20, the air duct 59 can be provided in a simple configuration.

Furthermore, in the present embodiment, the cooling air from the cooling fan 100 provided for cooling the components inside the printer main body 2 is applied to the rear face of the drum frame 20 via the duct. In other words, the cooling fan 100 for cooling the inside of the printer, main body 2 is also used as a blast unit for dust control. As a result, contamination of the LED 51 can be prevented without adding a blast unit disposed inside the printer main body 2.

On the holder 50, the paper feeding ribs 60 are provided so as to project from the space 58 toward the paper path 5. As a result, the transfer paper having been conveyed in the paper path 5 can be prevented from entering into the space 58, thereby reducing a risk of paper jam due to the transfer paper entering into the space 58.

Although the holes 52*a* to 52*d* are provided on the discharging printed board 48 and the notches 67 are provided on the holder 50 in the present embodiment, arrangement of the holes 52*a* to 52*d* and the notches 67 is not limited thereto. In another embodiment, notches can be provided on the discharging printed board 48 and holes can be provided on the holder 50. Alternatively, holes can be provided on both the discharging printed board 48 and the holder 50. Alternatively, notches can be provided on both the discharging printed board 48 and the holder 50.

What is claimed is:

1. An image forming apparatus comprising:

a photoreceptor drum that is provided along a paper path of transfer paper;

a discharging unit including a light emitting body that emits discharging light, the discharging unit eliminating electrical charge on a surface of the photoreceptor drum;

a blast unit that is provided to blow air toward the discharging unit; and an air duct that is provided in the vicinity of the light emitting body;

wherein the air from the blast unit toward the discharging unit is configured to blow to a side of the paper path through the air duct;

wherein the discharging unit includes the light emitting body, a discharging printed board, and a holder for holding the discharging printed board, wherein the discharging printed board has a first hole or notch fanned in the vicinity of the light emitting body and the holder has a second hole or notch at a position corresponding to the first hole or notch, and wherein the air duct is composed of the first hole or notch and the second hole or notch.

2. The image forming apparatus according to claim 1, further comprising a drum frame that is disposed to face the photoreceptor drum, wherein the holder is fixed onto the drum frame, and a space composing a part of the air duct on a side of the paper path is formed between the drum frame and the holder.

3. The image forming apparatus according to claim 2, wherein the space extends over in an axis direction of the photoreceptor drum, and one side of the space that faces the photoreceptor drum has an opening, and the light emitting body is provided at another side opposite to the one side so as to face the space, and the holder has a paper feeding rib that projects from the opening of the space toward the paper path.

4. The image forming apparatus according to claim 1, further comprising a charging unit that electrically charges the surface of the photoreceptor drum and a cleaning unit that cleans the surface of the photoreceptor drum, wherein the cleaning unit is disposed more on an upstream side in a rotation direction of the photoreceptor drum than the charging unit and the discharging unit is disposed more on an upstream side in the rotation direction of the photoreceptor drum than the cleaning unit.

* * * * *